United States Patent [19]

Warren

[11] 4,152,241

[45] May 1, 1979

[54] ELECTROPLATING FIXTURE

[75] Inventor: Gilbert G. Warren, Sidney, N.Y.

[73] Assignee: The Bendix Corporation, Southfield, Mich.

[21] Appl. No.: 874,297

[22] Filed: Feb. 1, 1978

[51] Int. Cl.[2] ..... C25D 17/08

[52] U.S. Cl. ..... 204/297 W

[58] Field of Search ..... 204/297 W, 297 R, 297 M

[56] References Cited

U.S. PATENT DOCUMENTS

| | | | |
|---|---|---|---|
| 2,137,819 | 11/1938 | Wagner | 204/297 W |
| 2,475,434 | 7/1949 | Moss | 204/297 W |
| 3,553,096 | 1/1971 | Coir | 204/297 W |

OTHER PUBLICATIONS

Belke Plating Manual, p. 52, Published by Belke Manufacturing Co., Chicago, 1947.

*Primary Examiner*—F. C. Edmundson

*Attorney, Agent, or Firm*—Raymond J. Eifler

[57] ABSTRACT

An assembly for facilitating the electroplating of the electrical contacts (30) of a hermetically sealed electrical connector. The fixture includes a plurality of springs (11) mounted on an insert (10) which has a plurality of holes (12) adapted to receive electrical contacts (30) and place all the electrical contacts in common electrical circuit relationship for electroplating.

6 Claims, 6 Drawing Figures

ELECTROPLATING FIXTURE

BACKGROUND OF THE INVENTION

This invention relates to hermetically sealed electrical connectors of the type usually comprised of a stainless steel shell having a glass insert therein in which electrical contacts of a nickel iron alloy composition have been fused into the glass insert at a temperature of about 1800° Fahrenheit. The electrical contacts are then electroplated with a material such as gold or silver to reduce the resistance of each of the contacts.

The invention is more particularly related to an electroplating fixture which facilitates the electroplating of the contacts.

It has been a longstanding practice in the electroplating of electrical contacts of hermetically sealed connectors to wire together, by hand, each of the electrical contacts that are mounted in the glass insert. The hand wiring connects each of the contacts together so that they will be substantially uniform, resulting in substantially uniform plating in the electroplating process. In the electroplating process, since all of the electrical contacts are connected together, a potential applied to one of the contacts attracts the gold or silver in the electroplating solution to all of the contacts, plating them.

Obviously, one of the main disadvantages with hand wiring each of these contacts, which are sometimes about 0.039 inches in diameter and fifty in number, is the time involved in connecting them together which increases the cost of the connector. Further, those surface portions of each electrical contact having the connecting wire wound around them prevents the plating of the contact on that surface. This is evident after the electroplating process as there are large unplated surface areas where the wires were located. The unplated area, of course, has a higher resistance than the plated area that can affect the overall resistance drop between mated electrical contacts. Therefore, the present electroplating process procedures are time consuming, expensive and leaves undesirably large surface areas of the contact unplated.

SUMMARY OF THE INVENTION

To significantly reduce the cost of manufacturing hermetically sealed electrical connectors and improve the overall plating of the contact, this invention provides a novel electroplating fixture.

The invention is an electrical connector electroplating assembly characterized by a plurality of springs (11) mounted on a base (10) which has a plurality of apertures (12) adapted to receive the electrical contacts (30) so that all the electrical contacts (30) touch an adjacent spring thereby placing all the contacts (30) in electrical circuit relationship with each other.

In one embodiment of the invention this is accomplished by an electrical connector electroplating assembly comprising: a dialectric insert (20) having a plurality of electrical contacts (30) mounted therein, said plurality of electrical contacts (30) extending from one end of said insert (20) and arranged in space relationship along a first plurality of parallel axes (A); a base member (10) having a plurality of holes (12) therein arranged in the same space relationship as the plurality of electrical contacts (30) in said insert (20), said base member (10) being mounted on said insert (20) with each of said contacts (30) extending through a respective hole (12) in said base (10); and a plurality of springs (11) mounted on said base member (10), each of said springs (11) mounted along axes (B) parallel to said first plurality of axes (A) so that each of said springs (11) touches each contact (30) adjacent said spring (11), whereby all of said electrical contacts (30) extending from said insert (20) are in electrical circuit relationship with each other.

Accordingly, it is an object of this invention to reduce the time and cost involved with electroplating the electrical contacts of an electrical connector.

It is a further object of this invention to improve the quality of the electro-deposited metal on each electrical contact by having a minimum amount of contact between the wire connecting together all of the electrical contacts.

It is another object of this invention to provide a novel electroplating fixture for manufacturing hermetically sealed electrical connectors.

It is another object of this invention to provide a hermetically sealed electrical connector at a lower cost and with improved overall plating on the contacts of the connector.

The above and other objects and features of the invention will become apparent from the following detailed description taken in conjunction with the accompanying drawings and claims which form a part of this specification.

A BRIEF DESCRIPTION OF THE DRAWINGS

DESCRIPTION OF THE PREFERRED EMBODIMENT

Figure 2:
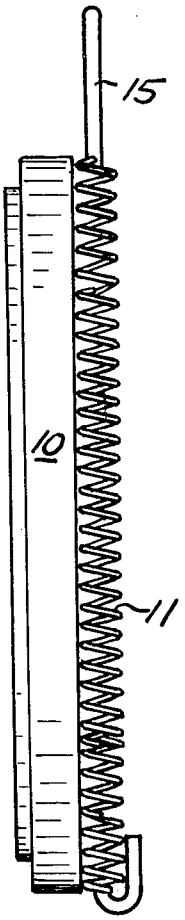
FIG. 2 is a side view of the electroplating fixture.
Figure 1:
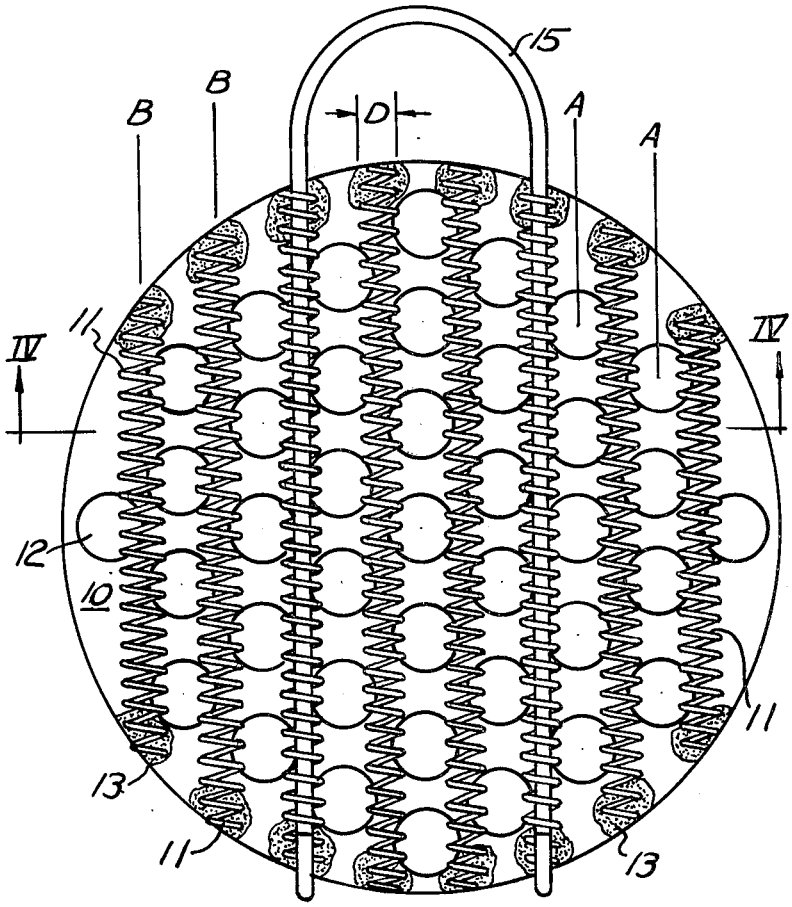
FIG. 1 is a top view of the electroplating fixture which accomplishes the objects of this invention.

Referring now to the drawings, FIG. 1 shows a top view of the novel electroplating fixture. The electroplating fixture comprises an insert (10) having a plurality of passages (12) and a plurality of springs (11) mounted on one side of the insert. The apertures (12) in the insert (10) are generally arranged along parallel axes (A) with the springs (11) mounted along parallel axes (B) parallel to the axes (A) of the passage ways (12) but spaced therefrom. The springs (11) are located between the parallel axes (A) of the apertures (12) with the diameter (D) of the springs (11) being such that a portion of each spring overlaps each hole (12) adjacent such spring. Attached to the fixture is a holder (15) for raising and lowering the fixture into the electroplating solution. fixture.

Figure 3:
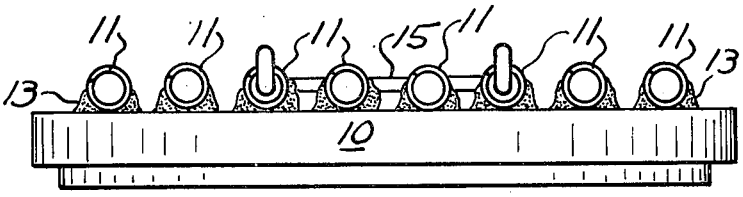
FIG. 3 is a front view of the electroplating fixture.

FIG. 3 shows a cut-away view of the electroplating fixture and illustrates how the springs (11) are attached to the insert (10) by cement or epoxy (13). Alternately, the springs (11) could be connected to each other or mounted to any shaped base member, e.g., a ring, so long as a portion of the springs (11) are arranged along parallel axes that would receive electrical contacts between the springs and spaced from each other so that each spring would contact each adjacent electrical contact.

Figure 4:
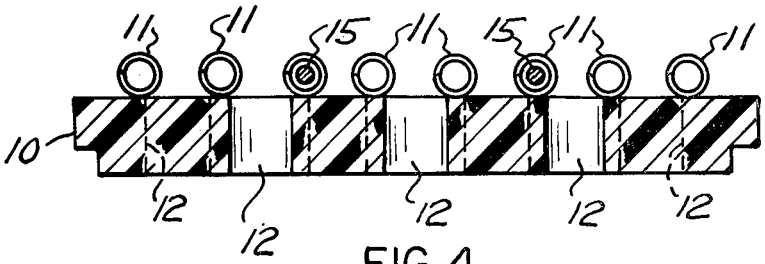
FIG. 4 is a cut-away view of the electroplating fixture.

FIG. 4 illustrates a cut-away view of the electroplating fixture and shows the arrangement of the passages (12) through the base (10) in relationship to the springs (11).

Figure 5:
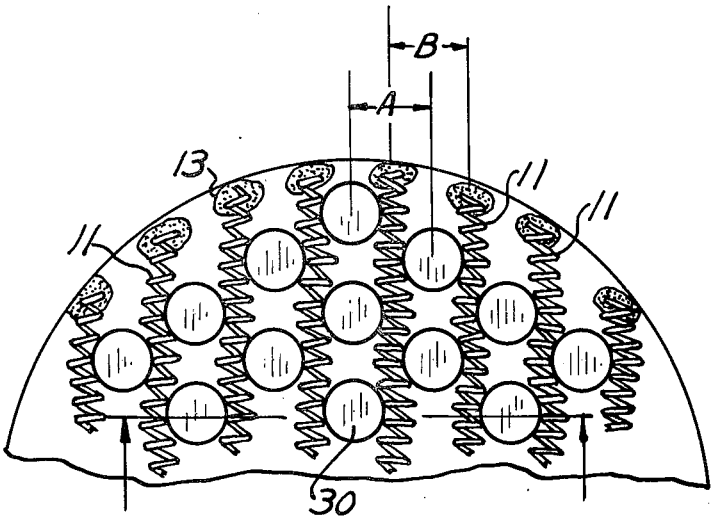
FIG. 5 is a partial view of the electroplating fixture mounted on an electrical connector with the electrical contacts extending through the fixture.

FIG. 5 shows a partial top view of the electroplating fixture with electrical contacts (30) extending through the apertures in the base (10) and in contact with adjacent springs (11). Since the diameter of the contacts (30) is slightly larger than the space between the adjacent springs (11) each contact (30) will contact a spring and deflect it. Since the springs are resiliently deflectable they may be repeatedly used for electroplating other electrical connector contacts. Other electrical conducting and resiliently deflectable means used to connect together the electrical contacts are steel wool, metal sponge, straight wires, plastic balls with metal coatings, and metal screening or mesh. However, all of the foregoing do not guarantee one hundred percent electrical connection between all the electrical contacts extending from an electrical connector insert. Accordingly, springs are preferred over all of the foregoing.

Preferrably, when electroplating size 20 contacts (0.039 inches in diameter) of an electrical connector having about 55 such electrical contacts, stainless steel wire springs are preferred. Preferrably, the diameter of the wire comprising the springs should be about 0.009 inches and the diameter of the spring itself should be about 0.074 inches when there is a 0.070 inch spacing between center lines of the electrical contacts of the connector. Further, it is preferred that the stainless steel wire springs have 37 turns per inch.

Figure 6:
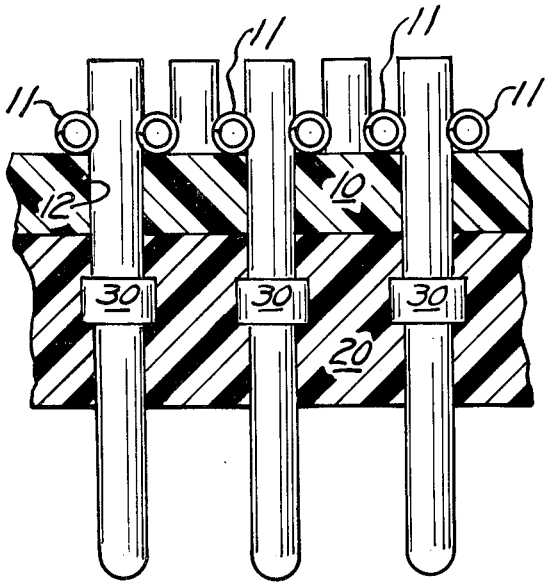
FIG. 6 is a partial cut-away view illustrating the electroplating fixture mounted on an electrical connector insert having contacts.

FIG. 6 illustrates a partial cut-away view of the electroplating fixture mounted on an electrical connector insert (20) having contacts (30) mounted therein. This expanded view illustrates how a portion of each contact (30) extends through a passageway (12) in the base (10) and contacts each spring (11) adjacent the aperture (12) in the base (10) through which the contact (30) has passed.

While a preferred embodiment of the invention has been disclosed, it will be apparent to those skilled in the art that changes may be made to the invention as set forth in the amended claims and, in some instances, certain features of the invention may be used to advantage without the corresponding use of other features.

Accordingly, it is intended that the illustrative and descriptive materials herein be used to illustrate the principals of the invention and not to limit the scope thereof.

Having described the invention, what is claimed is:

1. An electroplating assembly comprising:

a plurality of resiliently deflectable and electrically conducting coil-shaped springs, each of said coil springs having a central axis; and means for mounting said coil-shaped springs in predetermined spaced relationship with the central axis of each of said springs parallel to each other.

2. An electroplating assembly as recited in claim 1 wherein said means for mounting said springs include a base disposed in a plane parallel to the central axes of said springs, said base having at least one opening therein with at least one of said springs overlapping a portion of said opening.

3. An electrical connector electroplating assembly comprising:

a base member having a first plurality of parallel axes and a plurality of holes aligned along each of said axes; and a plurality of coil-shaped springs mounted on said base member each of said springs mounted along an axis parallel to said first plurality of axes so that each of said springs overlaps a portion of the holes arranged along a respective adjacent axis of said first plurality of axes.

4. An electrical connector electroplating assembly as recited in claim 3 wherein said base member is comprised of a dielectric material and said springs are electrically connected together.

5. An electrical connector electroplating assembly according to claim 4 wherein said base member is comprised of a dielectric material.

6. An electrical connector electroplating assembly comprising:

a base member having a plurality of holes; and a plurality of coil-shaped springs mounted on said base member, each of said springs mounted adjacent a respective hole and overlapping a portion of such adjacent hole.

* * * * *